US010971287B1

(12) United States Patent
Chen et al.

(10) Patent No.: US 10,971,287 B1
(45) Date of Patent: Apr. 6, 2021

(54) COMPOSITE CIRCUIT PROTECTION DEVICE

(71) Applicant: FUZETEC TECHNOLOGY CO., LTD., New Taipei (TW)

(72) Inventors: Jack Jih-Sang Chen, New Taipei (TW); Chang-Hung Jiang, New Taipei (TW)

(73) Assignee: FUZETEC TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/932,582

(22) Filed: Jul. 17, 2020

(51) Int. Cl.
*H01C 7/102* (2006.01)
*H01C 7/02* (2006.01)
*H01C 13/02* (2006.01)

(52) U.S. Cl.
CPC ..... *H01C 7/102* (2013.01); *H01C 7/021* (2013.01); *H01C 13/02* (2013.01)

(58) Field of Classification Search
CPC ..... H01C 7/102; H01C 7/021; H01C 13/02
See application file for complete search history.

(56) References Cited

U.S. PATENT DOCUMENTS 4,545,926 A * 10/1985 Fouts, Jr. ..... H01B 1/20 252/511
6,700,766 B2 * 3/2004 Sato ..... H02H 9/042 361/93.1
7,148,785 B2 * 12/2006 Becker ..... H05K 3/3426 338/22 R
8,446,245 B2 * 5/2013 Wang ..... H01C 7/027 338/21
8,508,328 B1 * 8/2013 Chen ..... H01C 7/02 338/22 R
10,418,158 B1 * 9/2019 Chen ..... H01C 1/028
2005/0030689 A1 * 2/2005 Toth ..... H01C 1/1406 361/103
2006/0197646 A1 * 9/2006 Suzuki ..... H01C 7/027 337/167
2007/0025044 A1 * 2/2007 Golubovic ..... H02H 9/042 361/124
2007/0170831 A1 * 7/2007 Sato ..... H01C 1/1406 313/11
2015/0155080 A1 * 6/2015 Chu ..... H01C 7/027 338/22 R

* cited by examiner

*Primary Examiner* — Kyung S Lee
(74) *Attorney, Agent, or Firm* — Hamre, Schumann, Mueller & Larson, P.C.

(57) ABSTRACT

A composite circuit protection device includes a positive temperature coefficient (PTC) component, a voltage-dependent resistor (VDR), and first and second conductive leads respectively bonded to the PTC component and the VDR. The PTC component includes a PTC layer having two opposite PTC surfaces, and first and second electrode layers each having an electrode surface which connects to and has an area smaller than that of a respective one of the PTC surfaces. The VDR includes a VDR layer having two opposite resistor surfaces, and third and fourth electrode layers each having an electrode surface which connects to and has an area smaller than that of a respective one of the resistor surfaces.

21 Claims, 6 Drawing Sheets

COMPOSITE CIRCUIT PROTECTION DEVICE

FIELD

The disclosure relates to a composite circuit protection device, and more particularly to a composite circuit protection device including a positive temperature coefficient (PTC) component and a voltage-dependent resistor, at least one of which have electrodes with reduced surface area.

BACKGROUND

Referring to FIG. 1, a conventional composite circuit protection device includes a positive temperature coefficient (FTC) component 12, a voltage-dependent resistor (VDR) 13, a first conductive lead 14, and a second conductive lead 15. The PTC component 12 includes a PTC layer 121, and first and second electrode layers 122, 123 having electrode surfaces that are respectively connected to two opposite surfaces of the PTC polymeric layer 121 and that have an area equal to an area of the two opposite surfaces of the PIC layer 121. The VDR 13 includes a voltage-dependent resistor layer 131, and third and fourth electrode layers 132, 133 having electrode surfaces that are respectively connected to two opposite surfaces of the voltage-dependent resistor layer 131 and that have an area equal to an area of the two opposite surfaces of the voltage-dependent resistor layer 131. The first and second conductive leads 14, 15 are respectively bonded to the first electrode layer 122 and the third electrode layers 132.

Electrical properties (e.g., operating current and high-voltage surge endurability) are important factors which affect the occurrence of power surge in the PTC component 12. When the operating current is increased by increasing the thickness or area size of the PTC component 12, the composite circuit protection device might become more vulnerable to power surge. On the other hand, when the high-voltage endurability of the PTC component 12 is increased by decreasing the thickness or the area size thereof, the composite circuit protection device is not necessarily less vulnerable to power surge.

Although a combination of the PTC component 12 and the VDR 13 could impart over-current and over-voltage protection to the composite circuit protection device, the VDR 13 might only withstand power surge for short time period (such as 0.001 seconds). That is, if a time period of the power surge exceeds a cut-off time period, the VDR 13 might be burned out or damaged due to over-current and over-voltage, causing permanent loss of function of the composite circuit protection device.

SUMMARY

Therefore, an object of the disclosure is to provide a composite circuit protection device that can alleviate at least one of the drawbacks of the prior art.

According to the disclosure, a composite circuit protection device includes a positive temperature coefficient (PTC) component, a voltage-dependent resistor, a first conductive lead, and a second conductive lead.

The PTC component includes a PTC layer having two opposite PTC surfaces, and first and second electrode layers each having an electrode surface connecting to a respective one of the two opposite PTC surfaces of the PTC layer.

The voltage-dependent resistor includes a voltage-dependent resistor layer having two opposite resistor surfaces, and third and fourth electrode layers. The third electrode layer has an electrode surface disposed between and connecting to one of the two opposite resistor surfaces of the voltage-dependent resistor layer and the second electrode layer of the PTC component. The fourth electrode layer has an electrode surface connecting to the other one of the two opposite resistor surfaces of the voltage-dependent resistor layer.

The first conductive lead is bonded to the first electrode layer of the PTC component. The second conductive lead is bonded to one of the third and fourth electrode layers of the voltage-dependent resistor.

The electrode surface of each of the first and second electrode layers has an area that is smaller than an area of a respective one of the PTC surfaces, or the electrode surface of each of the third and fourth electrode layers has an area that is smaller than an area of a respective one of the resistor surfaces.

BRIEF DESCRIPTION OF THE DRAWINGS

Other features and advantages of the present disclosure will become apparent in the following detailed description of the embodiments with reference to the accompanying drawings, of which.

DETAILED DESCRIPTION

Figure 1:
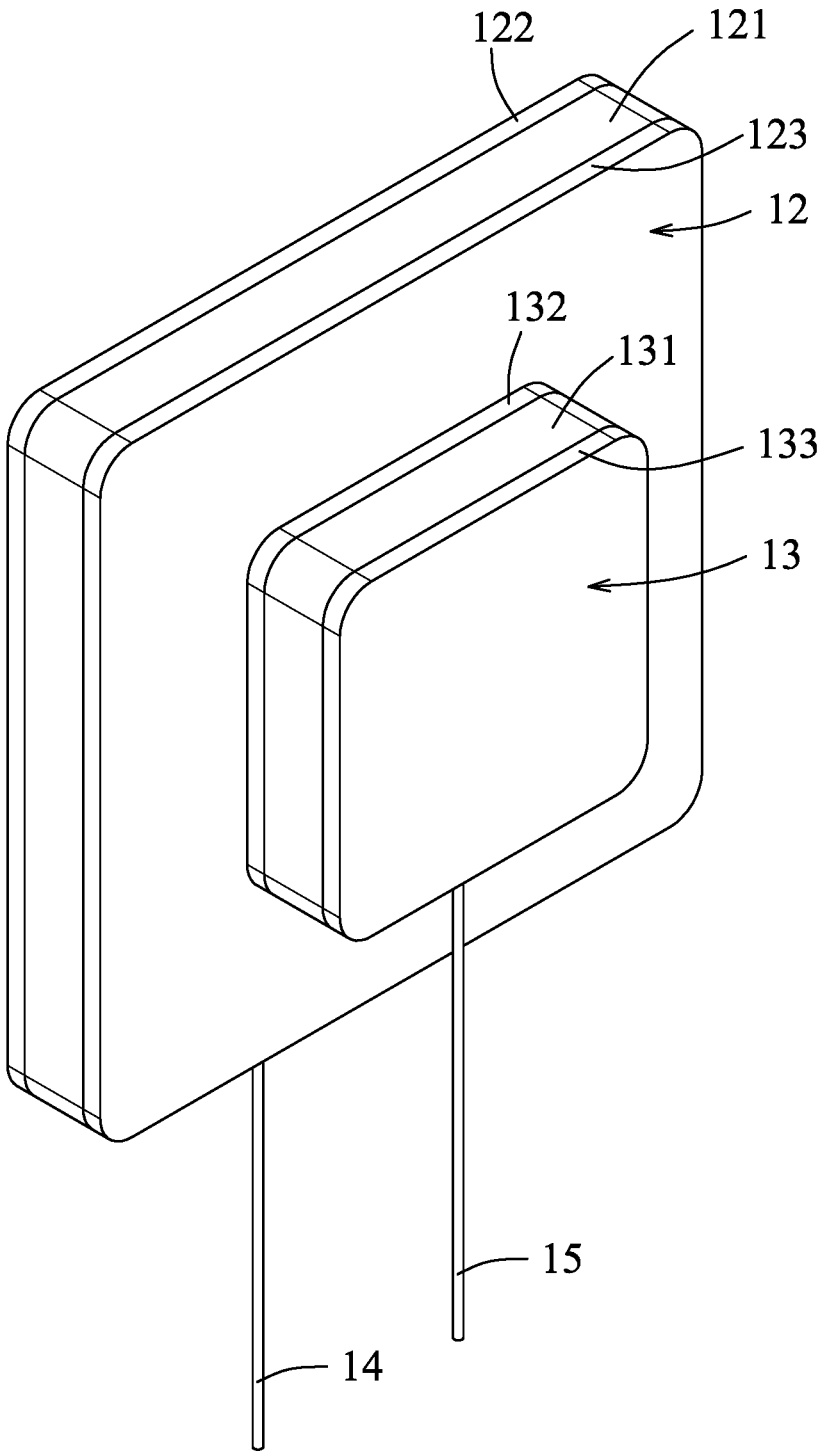
FIG. 1 PRIOR ART
FIG. 1 is a perspective view of a conventional composite circuit protection device.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
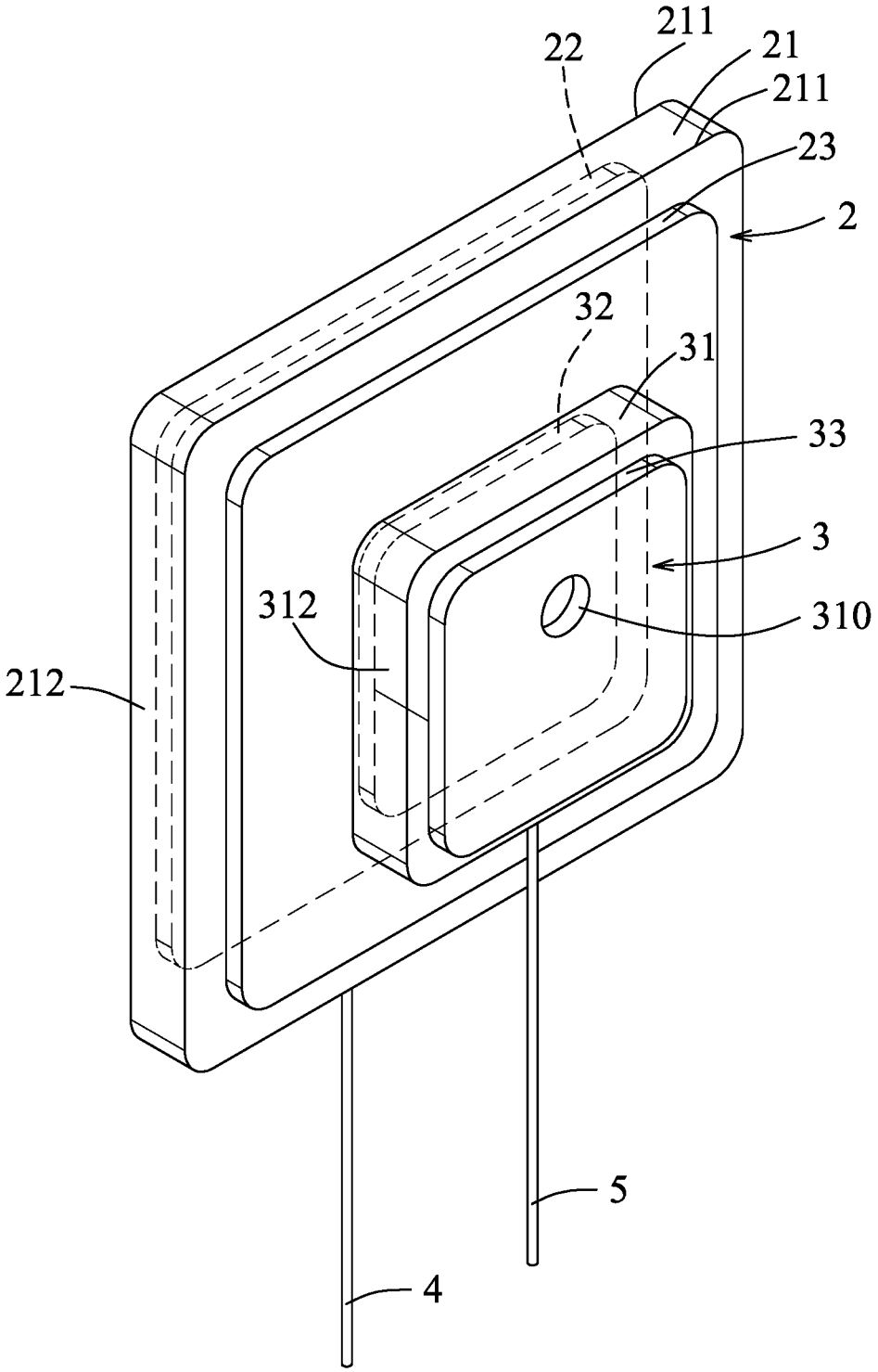
FIG. 2 is a perspective view of a first embodiment of a composite circuit protection device according to the present disclosure.
Figure 3:
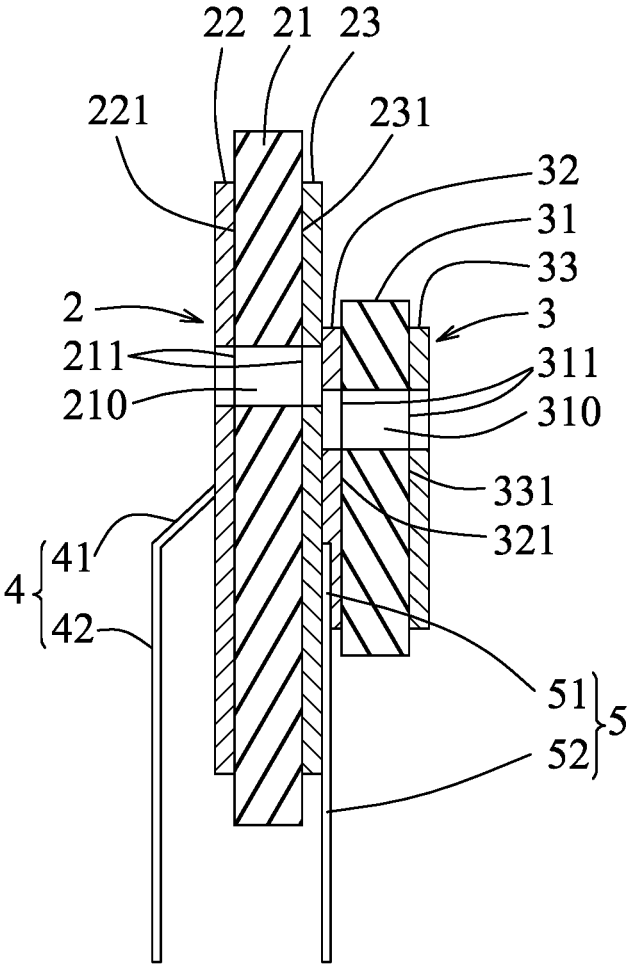
FIG. 3 is a schematic sectional view of the first embodiment.

Referring to FIGS. 2 and 3, a first embodiment of a composite circuit protection device according to the present disclosure includes a positive temperature coefficient (PTC) component 2, a voltage-dependent resistor 3, a first conductive lead 4, and a second conductive lead 5.

The PTC component 2 includes a PTC layer 21 having two opposite PTC surfaces 211, and first and second electrode layers 22, 23 each having an electrode surface 221, 231 connecting to a respective one of the two opposite PTC surfaces 211 of the PTC layer 21.

The voltage-dependent resistor includes a voltage-dependent resistor layer 31 having two opposite resistor surfaces 311, and third and fourth electrode layers 32, 33.

The third electrode layer 32 has an electrode surface 321 disposed between and connecting to one of the two opposite resistor surfaces 311 of the voltage-dependent resistor layer 31 and the second electrode layer 23 of the PTC component 2 through, e.g., a solder material. The fourth electrode layer 33 has an electrode surface 331 connecting to the other one of the two opposite resistor surfaces 311 of the voltage-dependent resistor layer 31 through, e.g., a solder material.

The first conductive lead 4 is bonded to the first electrode layer 22 of the PTC component 2. The second conductive lead 5 is bonded to one of the third and fourth electrode layers 32, 33 of the voltage-dependent resistor 3. In this embodiment, the second conductive lead 5 is bonded to and disposed between the second and third electrode layers 23, 32.

Each of the electrode surfaces 221, 231 of the first and second electrode layers 22, 23 may have an area that is smaller than an area of a respective one of the PTC surfaces 211. Each of the electrode surfaces 321, 331 of the third and fourth electrode layers 32, 33 may have an area that is smaller than an area of a respective one of the resistor surfaces 311.

In certain embodiments, each of the electrode surfaces 221, 231 of the first and second electrode layers 22, 23 has the area ranging from 70% to 90% of the area of the respective one of the PTC surfaces 211.

In other embodiments, each of the electrode surfaces 321, 331 of the third and fourth electrode layers 32, 33 has the area ranging from 70% to 90% of the area of the respective one of the resistor surfaces 311.

The PTC component 2 may have a rated voltage that ranges between 40% and 200% of a varistor voltage of the voltage-dependent resistor 3 as determined at 1 mA. In certain embodiments, the PTC component 2 has a rated voltage that ranges between 45% and 100% of the varistor voltage of the voltage-dependent resistor 3 as determined at 1 mA. In other embodiments, the PTC component 2 has a rated voltage that ranges between 45% and 70% of the varistor voltage of the voltage-dependent resistor 3 as determined at 1 mA.

According to this disclosure, the PTC component 2 trips before the voltage-dependent resistor 3 burns out in the presence of an over-current and a voltage that is greater than the varistor voltage of the voltage-dependent resistor 3. In other words, when an over-current and a voltage that is greater than the varistor voltage of the voltage-dependent resistor 3 are present, the PTC component 2 quickly trips to a high resistance state, such that the over-current is restricted from flowing through the voltage-dependent resistor 3, thereby protecting the voltage-dependent resistor 3 from burning out. The composite circuit protection device can therefore be repeatedly used.

As used herein, the terms "burn out", "spark" and "fire" can be used interchangeably, and indicates that the voltage-dependent resistor is out of function, which typically occurs at a temperature of 180° C. or higher.

In certain embodiments, the PTC component 2 trips within $10^{-6}$ seconds to 100 seconds in the presence of an over-current that is greater than 0.1 A and a voltage that is greater than the varistor voltage of the voltage-dependent resistor 3. In other embodiments, the PTC component 2 trips within $10^{-5}$ seconds to 10 seconds in the presence of an over-current that is greater than 0.1 A and a voltage that is greater than the varistor voltage of the voltage-dependent resistor 3. In yet other embodiments, the PTC component 2 trips within $10^{-4}$ seconds to 1 second in the presence of an over-current that is greater than 0.1 A and a voltage that is greater than the varistor voltage of the voltage-dependent resistor 3.

In certain embodiments, the PTC component 2 trips within $10^{-3}$ seconds to 10 seconds in the presence of an over-current that is greater than 0.5 A and a voltage that is greater than the varistor voltage of the voltage-dependent resistor 3. In other embodiments, the PTC component 2 trips within 10 seconds to 1 second in the presence of an over-current that is greater than 0.5 A and a voltage that is greater than the varistor voltage of the voltage-dependent resistor 3.

In certain embodiments, the PTC component 2 trips within $10^{-3}$ seconds to 1 second in the presence of an over-current that is greater than 10 A and a voltage that is greater than the varistor voltage of the voltage-dependent resistor 3. In other embodiments, the PTC component 2 trips within $10^{-3}$ seconds to 0.1 second in the presence of an over-current that is greater than 10 A and a voltage that is greater than the varistor voltage of the voltage-dependent resistor 3.

The PTC component 2 may be formed with a first hole 210. In this embodiment, the first hole 210 is formed in the PTC layer 21. The PTC layer 21 of the PTC component 2 has a peripheral edge 212 that defines a boundary of the PTC layer 21 and that interconnects the two opposite PTC surfaces 211 of the PTC layer 21. The first hole 210 is spaced apart from the peripheral edge 212, and has an effective volume to accommodate thermal expansion of the PTC layer 21 at increased temperature, so as to avoid undesired structural deformation of the PTC layer 21.

In certain embodiments, the first hole 210 extends through at least one of the two opposite PTC surfaces 211 of the PTC layer 21. In certain embodiments, the first hole 210 further extends through at least one of the first and second electrode layers 22, 23. In this embodiment, the first hole 210 extends through the two opposite PTC surfaces 211 of the PTC layer 21 and the first and second electrode layers 22, 23, so as to form a through hole. In certain embodiments, the first hole 210 extends along a line passing through a geometrical center of the PTC layer 21 and is transverse to the opposite PTC surfaces 211 of the PTC layer 21. The first hole 210 is defined by a hole-defining wall having a cross section that may be parallel to the PTC surface 211 of the PTC layer 21. The cross section of the hole-defining wall may be in a shape of circle, square, oval, triangle, crisscross, or etc.

According to this disclosure, the PTC component 2 may be a polymer positive temperature coefficient (PPTC) component, and the PTC layer 21 may be a PTC polymeric layer that includes a polymer matrix and a conductive filler dispersed in the polymer matrix. The voltage-dependent resistor layer 31 may be made of a metal-oxide material. The polymer matrix of the PTC polymeric layer may be made from a polymer composition that contains a non-grafted olefin-based polymer. In certain embodiments, the non-grafted olefin-based polymer is high density polyethylene (HDPE). In certain embodiments, the polymer composition of the polymer matrix further includes a grafted olefin-based polymer. In certain embodiments, the grafted olefin-based polymer includes a carboxylic acid anhydride-grafted olefin-based polymer. Examples of the conductive filler suitable for use in this disclosure include, but are not limited to, carbon black powder, metal powder, electrically conductive ceramic powder, and combinations thereof.

The voltage-dependent resistor 3 may be formed with a second hole 310 in the voltage-dependent resistor layer 31. In this embodiment, the voltage-dependent resistor layer 31 of the voltage-dependent resistor 3 has a peripheral edge 312 that defines a boundary of the voltage-dependent resistor layer 31 and that interconnects the two opposite resistor surfaces 311 of the voltage-dependent resistor layer 31. The second hole 310 is spaced apart from the peripheral edge 312 of the voltage-dependent resistor layer 31.

In certain embodiments, the second hole 310 extends through at least one of the two opposite resistor surfaces 311 of the voltage-dependent resistor layer 31. In certain embodiments, the second hole 310 further extends through at least one of the third and fourth electrode layers 32, 33. In this embodiment, the second hole 310 extends through the two opposite resistor surfaces 311 of the voltage-dependent resistor layer 31 and the third and fourth electrode layers 32, 33, so as to form a through hole.

According to the present disclosure, the first conductive lead 4 has a connecting portion 41 and a free portion 42, while the second conductive lead 5 has a connecting portion 51 and a free portion 52. The connecting portion 41 of the first conductive lead 4 is bonded to an outer surface of the first electrode layer 22 of the PTC component 2 through a solder material, and the free portion 42 extends outwardly from the connecting portion 41 beyond the first electrode layer 22 for insertion into a pin hole in a circuit board or a circuit device (not shown in the figures). In this embodiment, the connecting portion 51 of the second conductive lead 5 is bonded to and disposed between the second and third electrode layers 23, 32 through a solder material, and the free portion 52 extends outwardly from the connecting portion 51 beyond the second and third electrode layers 23, 32 for insertion into a pin hole in a circuit board or a circuit device (not shown in the figures).

Figure 4:
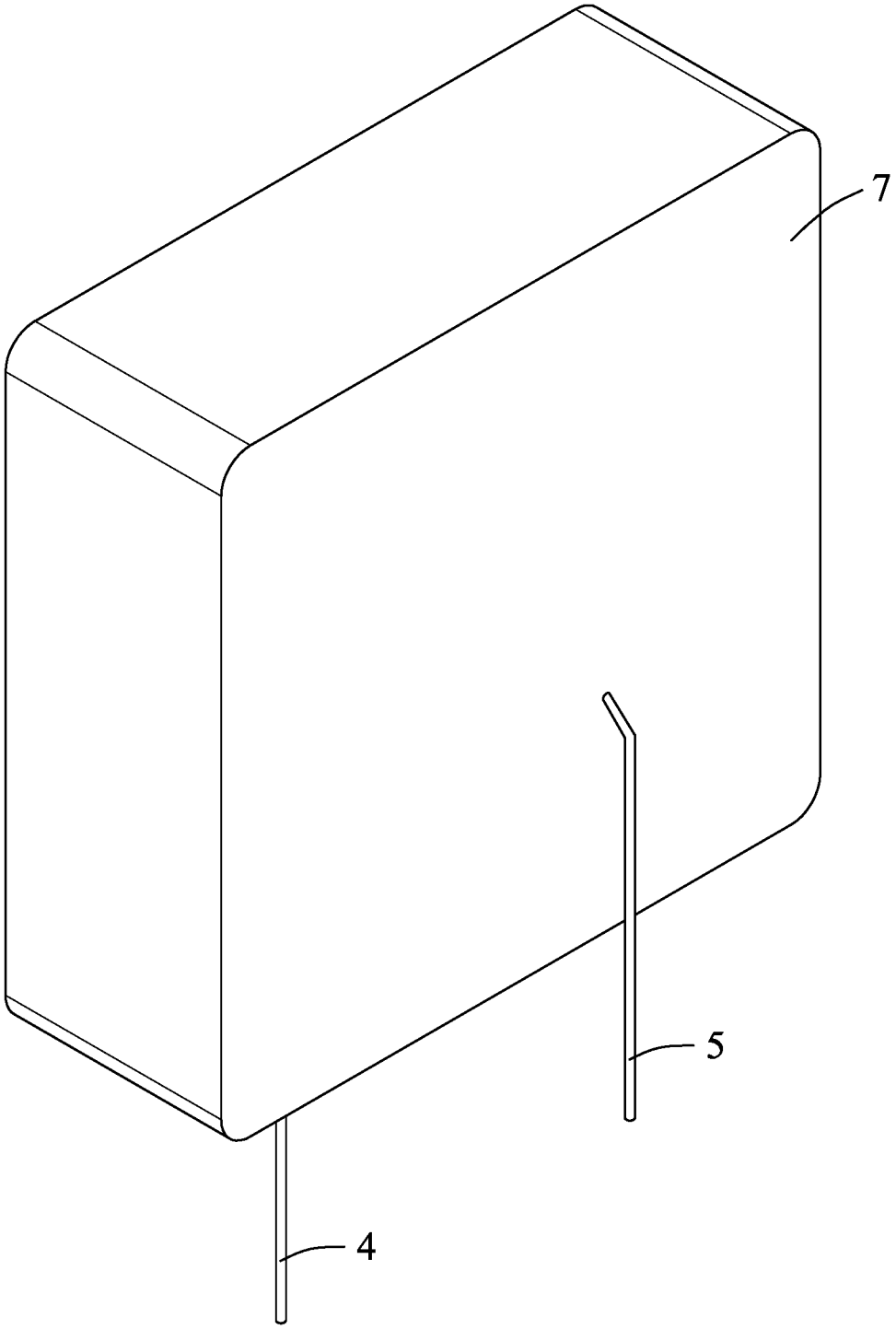
FIG. 4 is a perspective view of a second embodiment of the composite circuit protection device according to the present disclosure.
Figure 5:
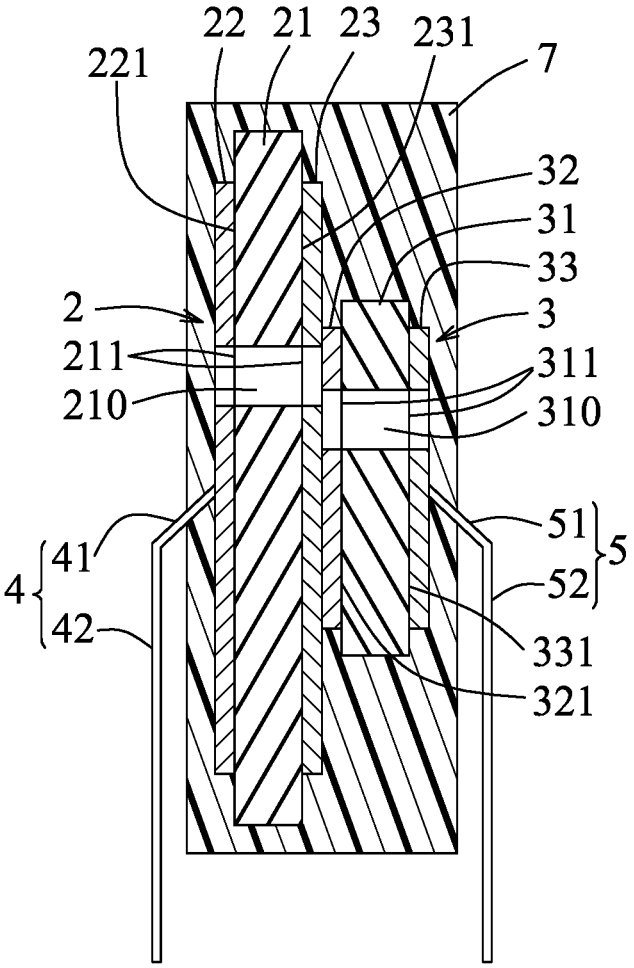
FIG. 5 is a schematic sectional view of the second embodiment.

Referring to FIGS. 4 and 5, a second embodiment of the composite circuit protection device according to the present disclosure is generally similar to the first embodiment. The difference resides in that, in the second embodiment, the connecting portion 51 of the second conductive lead 5 is bonded to an outer surface of the fourth electrode layer 33 of the voltage-dependent resistor 3 through a solder material, and the free portion 52 extends outwardly from the connecting portion 51 beyond the fourth electrode layer 33 for insertion into a pin hole in a circuit board or a circuit device (not shown in the figures). In addition, the second embodiment further includes an encapsulant 7 that encloses the PTC component 2, the voltage-dependent resistor 3, a part of the first conductive lead 4 and a part of the second conductive lead 5. The free portions 42, 52 of the first and second conductive leads 4, 5 are exposed from the encapsulant 7. In certain embodiments, the encapsulant 7 is made from epoxy resin.

Figure 6:
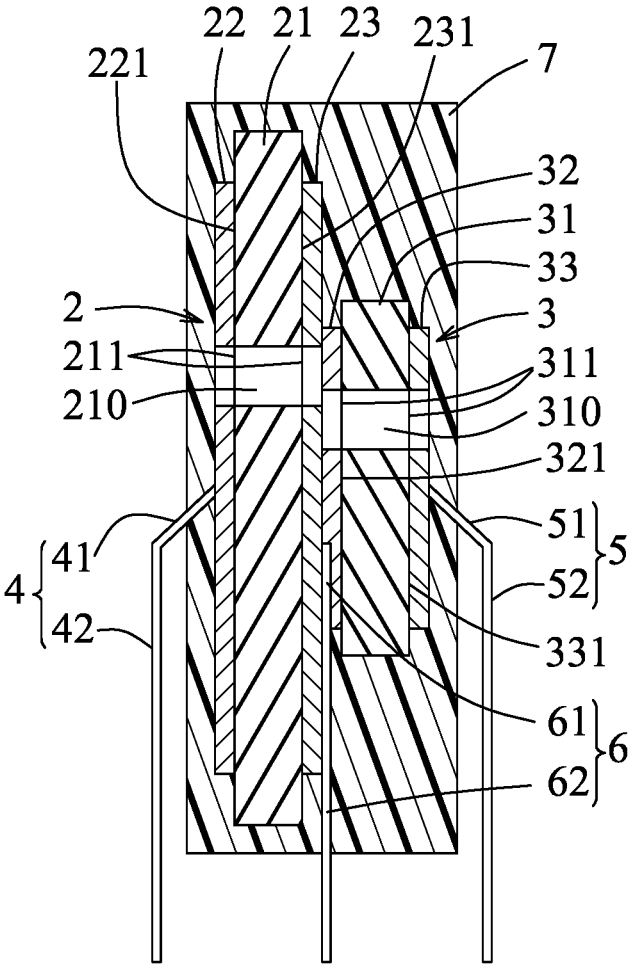
FIG. 6 is a schematic sectional view of a third embodiment of the composite circuit protection device according to the present disclosure.

Referring to FIG. 6, a third embodiment of the composite circuit protection device according to the present disclosure is generally similar to the second embodiment, except that the third embodiment further includes a third conductive lead 6. The third conductive lead 6 is bonded to and disposed between the second and third electrode layers 23, 32. The third conductive lead 6 has a connecting portion 61 that is connected to the second and third electrode layers 23, 32, and a free portion 62 that extends outwardly from the connecting portion 61 beyond the second and third electrode layers 23, 32 for insertion into a pin hole in a circuit board or a circuit device (not shown in the figures).

In this embodiment, the encapsulant 7 encloses the PTC component 2, the voltage-dependent resistor 3, a part of the first conductive lead 4, apart of the second conductive lead 5, and a part of the third conductive lead 6. The free portions 42, 52, 62 of the first, second and third conductive leads 4, 5, 6 are exposed from the encapsulant 7.

The disclosure will be further described by way of the following examples and comparative examples. However, it should be understood that the following examples are solely intended for the purpose of illustration and should not be construed as limiting the disclosure in practice.

EXAMPLES

Example 1 (E1)

10 grams of HDPE (purchased from Formosa Plastics Corp., Catalog no.: HDPE9002) serving as the non-grafted olefin-based polymer, 10 grams of maleic anhydride grafted HDPE (purchased from Dupont, Catalog no.: MB100D) serving as the carboxylic acid anhydride-grafted olefin-based polymer, 15 grams of carbon black powder (purchased from Columbian Chemicals Co., Catalog no.: Raven 430UB) serving as the conductive filler, and 15 grams of magnesium hydroxide (MagChem® NH 10) were compounded in a Brabender mixer. The compounding temperature was 200° C., the stirring rate was 30 rpm, and the compounding time was 10 minutes.

The resultant compounded mixture was hot pressed in a mold under 200° C. and 80 kg/cm$^2$ for 4 minutes so as to form a thin sheet of the PTC polymeric layer. Two copper foil sheets (serving as the first electrode layer and the second electrode layer, respectively) were respectively attached to the two opposite PTC surfaces of the PTC polymeric layer and were hot pressed under 200° C. and 80 kg/cm$^2$ for 4 minutes so as to form a polymer positive temperature coefficient (PPTC) component. The PPTC component was cut into a plurality of PPTC chips, each in a circular form having a thickness of 2.2 mm and a diameter of 14.5 mm (i.e., an area of about 165.0 mm$^2$).

Then, a type of a voltage-dependent resistor, i.e., a metal-oxide varistor (MOV) (Ceramate Technical Co., Ltd.; Model no.: 20D361K) in circular form, which includes a MOV layer having two opposite surfaces (each having a diameter of 20.0 mm, and an area of around 314.0 mm$^2$) and two electrode layers (i.e., third and fourth electrode layers) connecting to the two opposite surfaces, is subjected to an etching process to remove a portion of the electrode layers, such that each of the third and fourth electrode layers has a diameter of 18.9 mm and an area of around 280.4 mm$^2$. That is, the etched MOV has an electrode covering area of 89%, i.e., the area of each of the third and fourth electrode layers (280.4 mm$^2$) is about 89% of the area of a respective one of the two opposite surfaces of the MOV layer (314.0 mm$^2$).

Each PPTC chip was irradiated with a Cobalt-60 gamma ray for a total irradiation dose of 150 kGy. First and second conductive leads were then respectively welded to the two copper foil sheets of each PPTC chip, followed by welding of the etched MOV to one of the copper foil sheets of the PPTC chip, so as to form a composite circuit protection device of E1.

The PPTC chip was subjected to determination of a hold current (i.e., a maximum current value which can be applied in normal operation), a trip current (i.e., a minimum current value which is necessary for the PPTC component to achieve a high-resistance state), a rated voltage (i.e., a voltage at which the PPTC component is designed to work with) and a withstand voltage (i.e., a maximum voltage limit which will not caused the PPTC component to be malfunctioned or damaged) according to the Underwriter Laboratories UL 1434 Standard for Safety for Thermistor-Type Devices. In addition, before the etching process, the MOV was subjected to determination of a varistor voltage (i.e., a voltage at which the MOV is designed to work with) and a clamping voltage (i.e., a maximum voltage that can pass the MOV before it restricts further voltage from passing through the composite circuit protection device) according to the Underwriter Laboratories UL 1449 Standard for Safety for Transient Voltage Surge Suppressors. The characteristic results are shown in Table 1.

TABLE 1

| | Hold current (A) | Trip current (A) | Rated Voltage On | Withstand Voltage On |
|---|---|---|---|---|
| PPTC-2 | 0.08 A | 0.16 A | 250 V | 250 V |
| | | | Varistor Voltage[a] | Clamping Voltage[b] |
| MOV-2 | — | — | 360 V | 595 V |

—: not applicable
[a]determined at 1 mA
[b]determined at a test pulse waveform ($t_p$) of 8/20 μs and a test pulse current ($I_p$) of 2.5 A Examples 2 and 3 (E2 and E3)

The procedures and conditions in preparing the composite circuit protection devices of E2 and E3 were similar to those of E1, except that before irradiating with a Cobalt-60 gamma ray, the PPTC chip used in each of E2 and E3 is subjected to an etching process to remove a portion of the electrode layers, such that each of the first and second electrode layers has a diameter of 13.7 mm and an area of around 147.3 $mm^2$. That is, the etched PPTC chip has an electrode covering area of 89%, i.e., the area of each of the first and second electrode layers (147.3 $mm^2$) is about 89% of the area of a respective one of the two opposite PTC surfaces of the PTC polymeric layer (165.0 $mm^2$). In addition, the MOV used in E2 is not subjected to an etching process, i.e., having an electrode covering area of 100%.

Examples 4 to 12 (E4 to E12)

The procedures and conditions in preparing the composite circuit protection devices of E4 to E6, E7 to E9 and E10 to E12 were similar to those of E1 to E3, except that the PPTC chip is formed with a first through hole and/or the MOV is formed with a second through hole (see Table 2), each of the first and second through-holes being defined by a hole-defining wall with a circular cross section that has a diameter (d) of 1.5 mm and an area ($\pi d^2/4$) of 1.77 $mm^2$.

To be specific, in E4 to E6, after irradiating with Cobalt-60 gamma ray, a central portion of each PPTC chip was punched to form the first through hole. In E7 to E9, before welding to one of the copper foil sheets of the PPTC chip, a central portion of the NOV was punched to form the second through hole. In E10 to E12, a central portion of each PPTC chip was punched to form the first through hole and a central portion of the NOV was punched to form the second through hole as shown in FIG. 3.

Comparative Examples 1 to 4 (CE1 to CE4)

The procedures and conditions in preparing the composite circuit protection devices of CE1 to CE4 were respectively similar to those of E2, E3, E8 and E9, except that the PPTC chip was not included in CE1 to CE4.

Comparative Examples 5 to 8 (CE5 to CE8)

The procedures and conditions preparing the composite circuit protection devices of CE5 to CE8 were respectively similar to those of E1, E2, E4 and E5, except that the MOV was not included in CE5 to CE8.

Comparative Examples 9 to 12 (CE9 to CE12)

The procedures and conditions in preparing the composite circuit protection devices of CE9 to CE12 were respectively similar to those of E1, E7, E4 and E10, except that the MOV used in each of CE9 to CE12 has an electrode covering area of 100%.

For simplicity, the structure of the composite circuit protection devices of E1 to E12 and CE1 to CE12 are summarized in Table 2, where V is an indicator for existence.

TABLE 2

| | Composite circuit protection device | | | |
|---|---|---|---|---|
| | PPTC chip | | MOV | |
| | Electrode covering area (%) | First through hole | Electrode covering area (%) | Second through hole |
| E1 | 100 | | 89 | |
| E2 | 89 | | 100 | |
| E3 | 89 | | 39 | |
| E4 | 100 | V | 89 | |
| E5 | 89 | V | 100 | |
| E6 | 89 | V | 89 | |
| E7 | 100 | | 39 | V |
| E8 | 89 | | 100 | V |
| E9 | 89 | | 89 | V |
| E10 | 100 | V | 89 | V |
| E11 | 89 | V | 100 | V |
| E12 | 89 | V | 89 | V |
| CE1 | | | 100 | |
| CE2 | | | 89 | |
| CE3 | | | 100 | V |
| CE4 | | | 89 | V |
| CE5 | 100 | | | |
| CE6 | 89 | | | |
| CE7 | 100 | V | | |
| CE8 | 89 | V | | |
| CE9 | 100 | | 100 | |
| CE10 | 100 | | 100 | V |
| CE11 | 100 | V | 100 | |
| CE12 | 100 | V | 100 | V |

Performance Test

Surge Immunity Test

Ten composite circuit protection devices of each of E1 to E12 and CE1 to CE12, serving as test devices, were subjected to a surge immunity test.

Specifically, the surge immunity test for each test device was conducted in the presence of a voltage that is greater than the varistor voltage of the MOV (including 600 Vac and 700 Vac) and a current of 0.5 A or an over-current for the PPTC chip (i.e., 10 A), by switching on for 60 seconds and then off. If both of the PPTC chip and the MOV were not burned out and damaged, the test device was determined to pass the surge immunity test, and the time at which the PPTC chip of the test device tripped (i.e., trip time), if any, was recorded. If one of the PPTC chip and the MOV was burned out, the test device was determined as burned out, and the time at which the PPTC chip or the MOV was burned out (i.e., burned-out time) was recorded. The results are shown in Table 3.

TABLE 3

| | 600 Vac/0.5 A | | 600 Vac/10 A | | 700 Vac/0.5 A | | 700 Vac/10 A | |
|---|---|---|---|---|---|---|---|---|
| | Result | Time(s) | Result | Time(s) | Result | Time(s) | Result | Time(s) |
| E1 | Passed | 2.950 | Passed | 0.255 | Passed | 1.850 | Passed | 0.190 |
| E2 | Passed | 2.900 | Passed | 0.240 | Passed | 1.815 | Passed | 0.185 |
| E3 | Passed | 2.875 | Passed | 0.235 | Passed | 1.810 | Passed | 0.180 |
| E4 | Passed | 2.850 | Passed | 0.230 | Passed | 1.800 | Passed | 0.175 |
| E5 | Passed | 2.840 | Passed | 0.225 | Passed | 1.795 | Passed | 0.170 |
| E6 | Passed | 2.825 | Passed | 0.220 | Passed | 1.780 | Passed | 0.160 |
| E7 | Passed | 2.820 | Passed | 0.230 | Passed | 1.775 | Passed | 0.160 |
| E8 | Passed | 2.815 | Passed | 0.220 | Passed | 1.700 | Passed | 0.155 |
| E9 | Passed | 2.805 | Passed | 0.215 | Passed | 1.695 | Passed | 0.150 |
| E10 | Passed | 2.650 | Passed | 0.195 | Passed | 1.550 | Passed | 0.140 |
| E11 | Passed | 2.600 | Passed | 0.190 | Passed | 1.455 | Passed | 0.130 |
| E12 | Passed | 2.515 | Passed | 0.185 | Passed | 1.405 | Passed | 0.115 |
| CE1 | MOV Burned | 5.175 | MOV Burned | 0.965 | MOV Burned | 4.985 | MOV Burned | 0.865 |
| CR2 | MOV Burned | 5.170 | MOV Burned | 0.950 | MOV Burned | 4.975 | MOV Burned | 0.855 |
| CE3 | MOV Burned | 5.125 | MOV Burned | 0.950 | MOV Burned | 4.800 | MOV Burned | 0.855 |
| CE4 | MOV Burned | 5.110 | MOV Burned | 0.935 | MOV Burned | 4.750 | MOV Burned | 0.840 |
| CE5 | PPTC Burned | 9.175 | PPTC Burned | 0.285 | PPTC Burned | 9.170 | PPTC Burned | 0.280 |
| CE6 | PPTC Burned | 9.170 | PPTC Burned | 0.275 | PPTC Burned | 9.165 | PPTC Burned | 0.270 |
| CE7 | PPTC Burned | 9.165 | PPTC Burned | 0.275 | PPTC Burned | 9.150 | PPTC Burned | 0.255 |
| CE8 | PPTC Burned | 9.160 | PPTC Burned | 0.265 | PPTC Burned | 9.145 | PPTC Burned | 0.250 |
| CE9 | MOV Burned | 3.550 | PPTC Burned | 0.795 | MOV Burned | 3.330 | PPTC Burned | 0.765 |
| CE10 | MOV Burned | 3.400 | PPTC Burned | 0.775 | MOV Burned | 3.125 | PTC Burned | 0.750 |
| CE11 | MOV Burned | 3.355 | PPTC Burned | 0.770 | MOV Burned | 3.250 | PPTC Burned | 0.760 |
| CE12 | MOV Burned | 3.300 | PPTC Burned | 0.755 | MOV Burned | 3.050 | PPTC Burned | 0.735 |

Note:
For test devices with result that is shown as passed, the time recorded refers to the average time period for the PPTC chips of the test devices to be tripped.
For test devices with result that is shown as MOV burned, the time recorded refers to the average time period for the MOVs of the test devices to be burned out.
For test devices with result that is shown as PPTC burned, the time recorded refers to the average time period for the PPTC chips of the test devices to be burned out.

As shown in Table 3, each of the test devices of CE1 to CE4 containing only the MOV was burned out within 6 seconds under the over-current of 0.5 A and the over-voltage that is at least 1.4 times greater than the varistor voltage of the MOV (the MOV can generally withstand a voltage that is 1.2 times greater than the varistor voltage thereof), or burned out within 1 second under the over-current of 10 A and the over-voltage, and such damage cannot be repaired. In addition, each of the test devices of CE5 to CE8 containing only the PPTC chip was burned out under the over-current of 0.5 A or 10 A.

Although each of the test devices of CE9 to CE12 contains the PPTC chip and the MOV, both of which have the electrode covering area of 100%, the MOVs and the PPTC chips of the test devices were burned out under the over-voltage and the over-current of 0.5 A and 10 A, respectively.

In contrast, all of the test devices of E1 to E12 containing the combination of the PPTC chip and the MOV (where the PPTC chip and/or the MOV has an electrode covering area lower than 90%) passed the surge immunity test without being burned out, indicating that reducing the area of the electrode layers on the PPTC chip and/or the MOV may effectively prevent the damage of the test devices.

Moreover, as compared to E1 to E3, formation of the through hole in the PPTC chip and/or the MOV in the test devices of E4 to E12 improves the heat transfer, which may further shorten the time period for the PPTC chip to be tripped, and thus prevents the over-current from flowing through the MOV, thereby protecting the MOV of the test device from being burned out. In other words, in the test devices of E1 to E12, the PPTC chip trips before the MOV burns out in the presence of an over-current and a voltage that is greater than the varistor voltage of the MOV.

In conclusion, by controlling each of the electrode layers of the PTC component to have an area that is smaller than a respective one of the PTC surfaces, and/or by controlling each of the electrode layers of the voltage-dependent resistor to have an area that is smaller than a respective one of the resistor surfaces, the PTC component, which may quickly trip to a high-resistance state in the presence an over-current and an over-voltage, is capable of protecting the voltage-dependent resistor from being burned out due to undesired electric arc, and thus the composite circuit protection device of this disclosure may be repeatedly used without being damaged, which demonstrates its excellent endurability and reliability.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A composite circuit protection device, comprising:

a positive temperature coefficient (PTC) component formed with a first hole, the PTC component including:
- a PTC layer having two opposite PTC surfaces, and
- first and second electrode layers, each having an electrode surface connecting to a respective one of said two opposite PTC surfaces of said PTC layer, said first hole being formed in said PTC layer;

a voltage-dependent resistor formed with a second hole, the voltage-dependent resistor including:
- a voltage-dependent resistor layer having two opposite resistor surfaces,
- a third electrode layer having an electrode surface disposed between and connecting to one of said two opposite resistor surfaces of said voltage-dependent resistor layer and said second electrode layer of said PTC component, and
- a fourth electrode layer having an electrode surface connecting to the other one of said two opposite resistor surfaces of said voltage-dependent resistor layer;

a first conductive lead that is bonded to said first electrode layer of said PTC component; and a second conductive lead that is bonded to one of said third and fourth electrode layers of said voltage-dependent resistor, wherein said electrode surface of each of said first and second electrode layers has an area that is smaller than an area of a respective one of said PTC surfaces, or said electrode surface of each of said third and fourth electrode layers has an area that is smaller than an area of a respective one of said resistor surfaces.

2. The composite circuit protection device of claim 1, wherein the area of said electrode surface of each of said first and second electrode layers ranges from 70% to 90% of the area of the respective one of said PTC surfaces.

3. The composite circuit protection device of claim 1, wherein the area of said electrode surface of each of said third and fourth electrode layers ranges from 70% to 90% of the area of the respective one of said resistor surfaces.

4. The composite circuit protection device of claim 1, wherein said PTC component has a rated voltage that ranges between 40% and 200% of a varistor voltage of said voltage-dependent resistor as determined at 1 mA.

5. The composite circuit protection device of claim 1, wherein said PTC component has a rated voltage that ranges between 45% and 100% of the varistor voltage of said voltage-dependent resistor as determined at 1 mA.

6. The composite circuit protection device of claim 1, wherein said PTC component has a rated voltage that ranges between 45% and 70% of the varistor voltage of said voltage-dependent resistor as determined at 1 mA.

7. The composite circuit protection device of claim 1, wherein said PTC component trips before said voltage-dependent resistor burns out in the presence of an over-current and a voltage that is greater than the varistor voltage of said voltage-dependent resistor.

8. The composite circuit protection device of claim 7, wherein said PTC component trips within $10^{-6}$ seconds to 100 seconds in the presence of an over-current that is greater than 0.1 A and a voltage that is greater than the varistor voltage of said voltage-dependent resistor.

9. The composite circuit protection device of claim 7, wherein said PTC component trips within $10^{-3}$ seconds to 10 seconds in the presence of an over-current that is greater than 0.5 A and a voltage that is greater than the varistor voltage of said voltage-dependent resistor.

10. The composite circuit protection device of claim 7, wherein said PTC component trips within $10^{-3}$ seconds to 1 second in the presence of an over-current that is greater than 10 A and a voltage that is greater than the varistor voltage of said voltage-dependent resistor.

11. The composite circuit protection device of claim 1, wherein said PTC layer of said PTC component has a peripheral edge defining a boundary of said PTC layer and interconnecting said two opposite PTC surfaces of said PTC layer, said first hole being spaced apart from said peripheral edge of said PTC layer.

12. The composite circuit protection device of claim 1, wherein said first hole extends through at least one of said two opposite PTC surfaces of said PTC layer.

13. The composite circuit protection device of claim 12, wherein said first hole further extends through at least one of said first and second electrode layers.

14. The composite circuit protection device of claim 1, further comprising a third conductive lead, said second conductive lead being bonded to said fourth electrode layer, said third conductive lead being bonded to and disposed between said second and third electrode layers.

15. The composite circuit protection device of claim 1, wherein said second hole is formed in said voltage-dependent resistor layer.

16. The composite circuit protection device of claim 15, wherein said voltage-dependent resistor layer of said voltage-dependent resistor has a peripheral edge that defines a boundary of said voltage-dependent resistor layer and that interconnects said two opposite resistor surfaces of said voltage-dependent resistor layer, said second hole being spaced apart from said peripheral edge of said voltage-dependent resistor layer.

17. The composite circuit protection device of claim 15, wherein said second hole extends through at least one of said two opposite resistor surfaces of said voltage-dependent resistor layer.

18. The composite circuit protection device of claim 17, wherein said second hole further extends through at least one of said third and fourth electrode layers.

19. The composite circuit protection device of claim 1, wherein said PTC component is a polymer positive temperature coefficient (PPTC) component, and said PTC layer is a PTC polymeric layer.

20. The composite circuit protection device of claim 1, further comprising an encapsulant enclosing said PTC component, said voltage-dependent resistor, a part of said first conductive lead, and a part of said second conductive lead.

21. A composite circuit protection device, comprising:

a positive temperature coefficient (PTC) component that includes a positive temperature coefficient (PTC) layer having two opposite PTC surfaces, and first and second electrode layers, each having an electrode surface connecting to a respective one of said two opposite PTC surfaces of said PTC layer;

a voltage-dependent resistor that includes a voltage-dependent resistor layer having two opposite resistor surfaces, a third electrode layer having an electrode surface that connects to one of said two opposite resistor surfaces of said voltage-dependent resistor layer and that is disposed between said one of said two opposite resistor surfaces of said voltage-dependent resistor layer and said second electrode layer of said PTC component, and a fourth electrode layer having an electrode surface connecting to the other one of said two opposite resistor surfaces of said voltage-dependent resistor layer;

a first conductive lead that is bonded to said first electrode layer of said PTC component; and a second conductive lead that is bonded to one of said third and fourth electrode layers of said voltage-dependent resistor, wherein said electrode surface of each of said first and second electrode layers has an area that is smaller than an area of a respective one of said PTC surfaces, or said electrode surface of each of said third and fourth electrode layers has an area that is smaller than an area of a respective one of said resistor surfaces, and wherein said voltage-dependent resistor is formed with a hole that is formed in said voltage-dependent resistor layer.

* * * * *